US006347658B1

(12) United States Patent
Judkins

(10) Patent No.: US 6,347,658 B1
(45) Date of Patent: Feb. 19, 2002

(54) PLEATED SHADE WITH INTERMITTENT TABS

(76) Inventor: Ren Judkins, 46 Newgate Rd., Pittsburgh, PA (US) 15202

( * ) Notice: Subject to any disclaimer, the term of this patent is extended or adjusted under 35 U.S.C. 154(b) by 0 days.

(21) Appl. No.: 09/495,135

(22) Filed: Jan. 31, 2000

(51) Int. Cl.[7] ..... E06B 3/48
(52) U.S. Cl. ..... 160/84.04; 428/179
(58) Field of Search ..... 160/84.01, 84.04, 160/84.05; 156/290, 291; 428/179, 180, 181, 183, 186

(56) References Cited

U.S. PATENT DOCUMENTS 3,146,784 A * 9/1964 Silver
4,747,442 A * 5/1988 Bade
4,880,044 A 11/1989 Judkins ..... 160/84.1
4,974,656 A 12/1990 Judkins ..... 160/84.1
5,043,038 A * 8/1991 Colson
5,273,097 A * 12/1993 Siegler
5,996,673 A * 12/1999 Iban et al.

* cited by examiner

*Primary Examiner*—Blair M. Johnson
(74) *Attorney, Agent, or Firm*—Buchanan Ingersoll, P.C.

(57) ABSTRACT

An intermittently tabbed pleated shade in which alternate pleats are tabbed at spaced apart locations along their length, giving the pleats a textured appearance when the shade is extended in the lowered position. An intermittently tabbed pleated shade device has a headrail and a bottomrail, to which the top and bottom of the pleated shade, respectively, are connected. Preferably there is a set of vertically aligned tabs for each lift cord, each tab having at least one cord hole through which a lift cord may pass. In this shade pleated material is intermittently secured together at each of adjacent back projecting pleats to form intermittent tabs at spaced apart locations along the width of the pleated material at a rear portion of each back projecting pleat such that when the shade is lowered each of the intermittently tabbed pleats has a textured appearance. Optionally, a spacer device can be used to maintain a desired vertical spacing between tabs.

16 Claims, 4 Drawing Sheets

FIG. 3
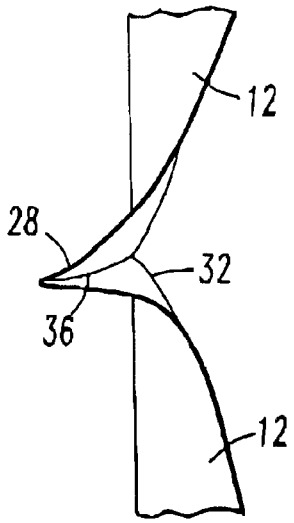
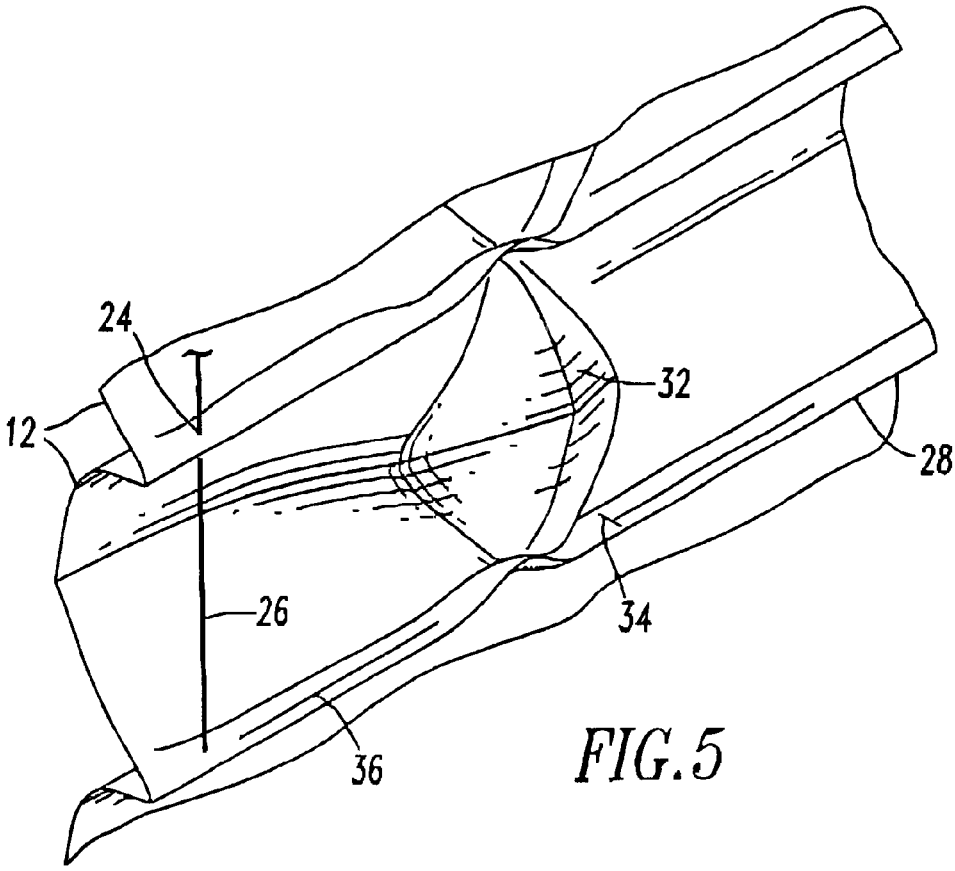
FIG. 5

PLEATED SHADE WITH INTERMITTENT TABS

BACKGROUND

1. Field of the Invention

This invention relates generally to a pleated shade, and more particularly to a pleated shade wherein the pleats have intermittent tabs which gives the shade a softer appearance when extended.

2. Background of the Invention

In a standard pleated shade construction, a piece of material is pleated into a plurality of horizontal sections which stack one on top of the other when the shade is in its raised position. Alternate pleats face toward the front and rear of the shade. Each section has at least one hole punched preferably through the transverse center thereof which holes are aligned when the shade is folded. Normally, there would be two or more aligned rows of holes formed in the shade sections. Lift cords passing through the aligned holes are utilized to control the raising and lowering of the shade and also control the folding of the pleat.

Another way to make a pleated shade is disclosed in my U.S. Pat. No. 4,974,656, which describes a pleated shade construction which does not result in cords and holes being visible from the front of the shade, which provides enhanced energy efficiency, stronger and more durable pleats and enhanced rigidity in some applications while still being relatively simple and inexpensive to fabricate. The shade includes a headrail, a bottomrail, and a piece of material having a plurality of pleats preformed therein, alternate pleats projecting towards the front, and back of the material The material is connected at one end to the headrail and at the other end to the bottomrail. A means is provided for securing together the two sections of material forming each of the back projecting pleats along substantially the entire width of the material to form a narrow tab projecting from the rear of each of such pleats The sections may be secured together by welding, gluing, sewing or other suitable means. Cord holes are formed in each of the tabs, corresponding holes being accurately aligned, and a lift cord extends from the headrail through each aligned set of cord holes to the bottomrail. The pleated shade utilizes rear projecting tabs which permits two sections of pleated shade to be easily and invisibly spliced together. The rigidity of the pleats may be enhanced by providing a double-weld joint for the tab or by otherwise providing a multiple or continuous bond between the two fabric layers forming the tab. The joints used to form the tabs may be used as splice joints to secure together two pieces of shade material.

However, this and other prior art pleated shades typically exhibit a rectilinear or "hard" appearance, due in part to the material used to make the shade which is coated to hold the permanent creases and also due in part to the method of manufacture. Conventional methods of constructing the pleated material for a simple, single pleat type of shade involve either creasing the entire length of material at regular intervals, creasing portions of material and creating tabs which may be joined together to form, or repair, a shade from more than a single piece of material, to as described my U.S. Pat. No. 4,974,656. The "hard" appearance generally results because the crease or the tabs used to form the pleats are continuous along the entire width of the shade material and very straight, even sharp.

Accordingly, in order to provide a more aesthetically pleasing pleated shade, it is desirable to provide a pleated shade which has a "softer," more textured appearance than conventional pleated shades.

SUMMARY

A pleated shade with intermittent tabs is provided, in which alternate pleats are tabbed intermittently along their length. The intermittent tabs give the pleats a textured appearance when the shade is extended in the lowered position. The intermittently tabbed pleated shade can include typical components such as a headrail and a bottomrail, to which the top and bottom of the pleated shade, respectively, are connected. Preferably there are sets of vertically aligned tabs; at least one and usually two or more sets of tabs will have aligned cord holes through which a lift cord can pass.

To form the intermittently tabbed pleated shade, a piece of material is provided which has a plurality of horizontal sections of material or pleat faces, each pair of adjacent horizontal sections meeting at a pleat which has been preformed therein such that the horizontal sections stack one on top of the other when the shade is in its raised position. The pleats project alternately towards front and back of the material. One end of the material is connected to the headrail and the other end to the bottomrail. Respective adjacent horizontal sections of material, which form the back projecting pleats, are intermittently secured together at spaced apart locations along the width of the material. This creates a number of intermittent tabs across the rear portion of each of the back projecting pleats which, when the shade is lowered, results in each of the intermittently tabbed pleats having a textured appearance. This arrangement puts a tremendous stress on the edges of the bondline at the tab. Even the fabric may fail at this point. Ultrasonic and heat welding are desirable methods of tabbing because they do not introduce additional material that would make the stack uneven and difficult to drill accurately.

Preferably a soft material of the type having more of a drapery hand or "feel" is used. Such material will have smoother, fuller contours than stiffer materials. When using softer materials it may be necessary to support the tabs to protect the peel bonds from too much stress and to guarantee consistent folding over time. Spacing systems are provided on the tab side of the shade.

Other details, objects, and advantages of the invention will become apparent from the following detailed description and the accompanying drawings figures of certain embodiments thereof.

BRIEF DESCRIPTION OF THE DRAWING FIGURES

A more complete understanding of the invention can be obtained by considering the following detailed description in conjunction with the accompanying drawings, in which:

FIG. 3 is a side cross sectional view of the pleated shade shown in FIG. 2 taken along the line III—III in FIG. 2.

FIG. 5 is an enlarged perspective view of a portion of the pleated shade shown in FIG. 4.

DETAILED DESCRIPTION OF CERTAIN EMBODIMENTS

Figure 1:
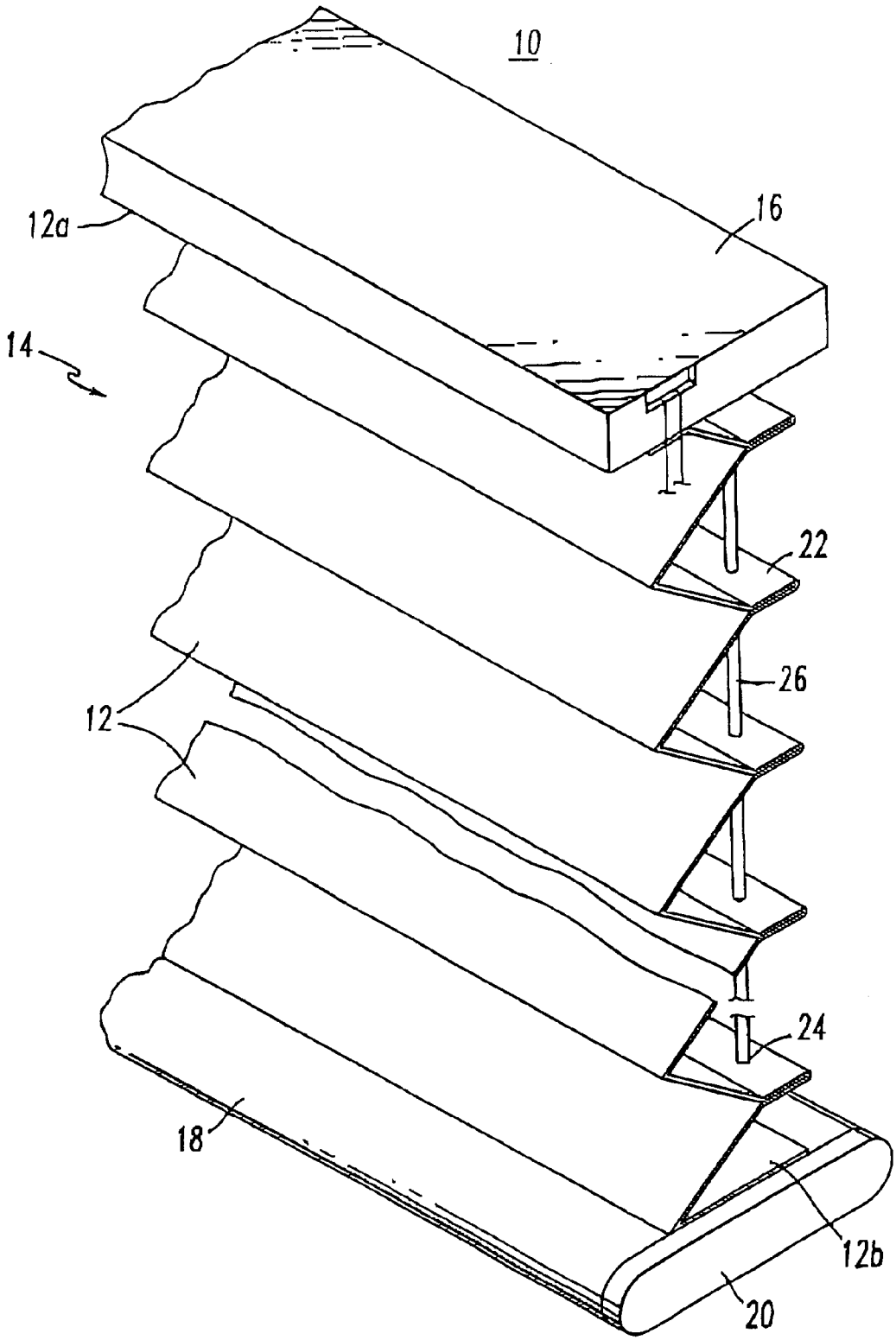
FIG. 1 PRIOR ART
FIG. 1 is a front perspective view of a portion of a prior art pleated shade.

A prior art pleated shade 10 is shown in FIG. 1, having a conventional appearance wherein each pleat 12 of a prepleated material 14 appears generally rigid, having smooth flat surfaces. In the industry, this appearance is sometimes referred to as a "hard" appearance, in as much as it has a flat, rigid, angularly symmetrical appearance. This type of appearance generally results from both the method of manufacturing the pleated shade 10 and the nature of the material 14 from which the shade is commonly made. Of course, pleated shades made from a softer material may have a correspondingly less rigid appearance. Drapery type materials are seldom used for pleated shades because they tend to flatten when hung, thereby losing their pleated appearance. Consequently, when very flexible materials such as cotton are used the material is coated with a stiffening material similar to starch. However, a pleated shade made according to the invention has a softer, more textured look, as illustrated in FIG. 2, notwithstanding the type of material from which the shade is made.

Conventional pleated shades can be constructed using a number of different known techniques. For example, as described in my aforementioned U.S. Pat. No. 4,974,656, the prior art shade shown in FIG. 1 includes a headrail 16, which may be of standard construction and a bottomrail 18. A piece of pleated material 14 has a top pleat 12*a* connected to a headrail 16 in a conventional fashion and has a bottom pleat 12*b* connected to a bottomrail 18. The bottom pleat 12*b* is glued or otherwise secured to the top the bottomrail 18. An end cap 20 is fitted on each end of bottomrail 18 to provide a finished appearance. If desired, a piece of material (not shown), which is either the same as material 14, or contrasts thereto in an aesthetically pleasing manner, may be fitted over bottomrail 18 with the free ends thereof secured thereto by gluing or other suitable means. The material forming each of the rear pleats of the material 14 are secured together along substantially the entire width of the shade and at a point a short distance from the pleat to form a rear tab 22. The joint or seam which creates the substantially continuous tab 22 may be formed by ultrasonic welding, sewing, gluing or other suitable means. The width of the tab 22 may vary from shade to shade; but the commercial embodiment of the shade shown in FIG. 1 has had a ⅝" width. Each of the substantially continuous tabs 22 has at least one cord hole 24 formed therein. The exact number of cord holes 24 will vary with the width of the shade 10 and the rigidity of the material 14, but most shades 10 will have at least two cord holes 24. The cord holes in each of the tabs 22 are aligned so that a cord 26 may pass therethrough. In addition to passing through the cord holes 24 in tabs 22, the cord 26 enters the headrail 16 in a conventional fashion and passes over conventional mechanisms including locking mechanisms in headrail 16 and out the side thereof to control the raising and lowering of the pleated shade 10. The cord 26 may also pass through a hole provided in the center of the bottomrail 16. The lower end of the cord 26 is knotted, attached to a ring or washer, or otherwise held in the bottomrail 18 in a conventional manner. In addition to the above described method, various other well know methods can be utilized to make conventional pleated shades. However, pleated shades made according to any conventional method of making such window coverings will have pleats which exhibit the usual smooth, flat, rigid appearance. This appearance results from the crease, or a tab, which extends substantially continuously across the entire width of each pleat.

Figure 2:
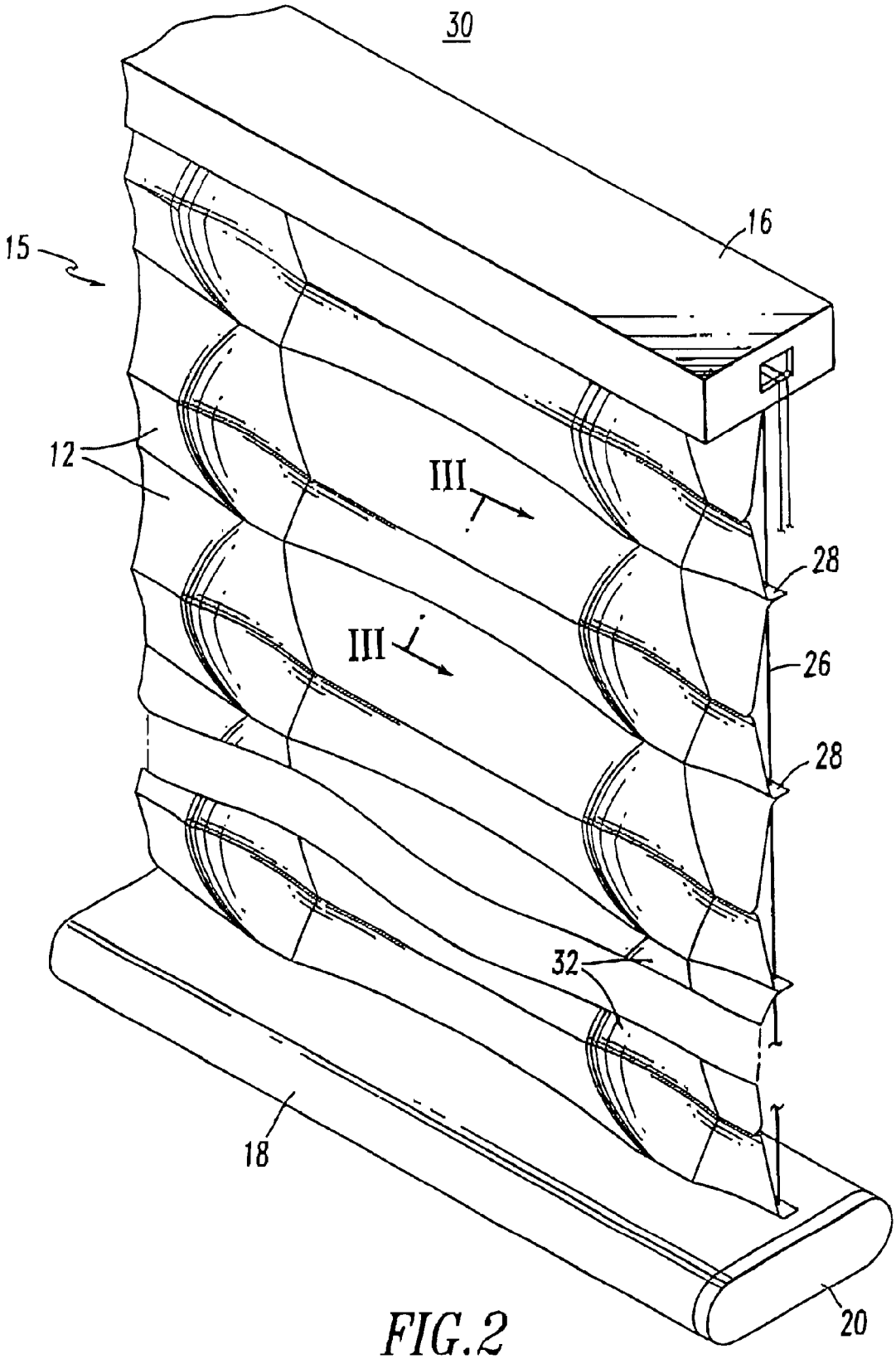
FIG. 2 is a front perspective view of a portion of a pleated shade of a first embodiment of the invention having tabbed pleats.

In contrast to prior art methods of making pleated shades, of which the above described manner is but one example, a pleated shade 30 according to the invention, exhibits a soft, textured appearance such as shown in FIG. 2. This textured appearance is the result of tabbing the pleated material 15 only at intermittent points across the width of the pleats 12, rather than continuously. As can be seen, the pleated material 15 of the shade 30 is secured at spaced apart locations along the width of the pleats 12, where the back projecting pleats are created, or otherwise joined to form the intermittent tabs 28. However, between the tabbed portions 28 the material 15 is not joined except at the crease, or the line where the pleats 12 are joined. Consequently, as the shade 30 is extended the material between the tabs 28 is pulled slightly apart, thus interrupting the otherwise flat surfaces of each pleat 12. As illustrated best in FIG. 3, at locations intermediate the tabbed portions 28 of the pleats 12 the material 15 "puffs" outward, as indicated by reference number 32, resulting in a rumpled appearance across the width of the pleats 12. The degree to which the material 15 puffs out between the tabbed portions 28, and thus the degree of "rumpling," is largely dependent on the spacing between the tabbed portions 28, the relative softness or hardness of the pleated material 15 and the ratio of the vertical length of fabric taken up versus the tab. In the extreme the fabric column that is tabbed becomes nearly flat and the fabric space between the tabs may be twice as long and contour back and forth to fill the space. In contrast, if the pleated material 15 were simply creased or a continuous tab were provided across the width of each pleat 12, the appearance would be the smooth, generally rigid looking pleats 12 exhibited typically by prior art pleated shades 10.

Figure 4:
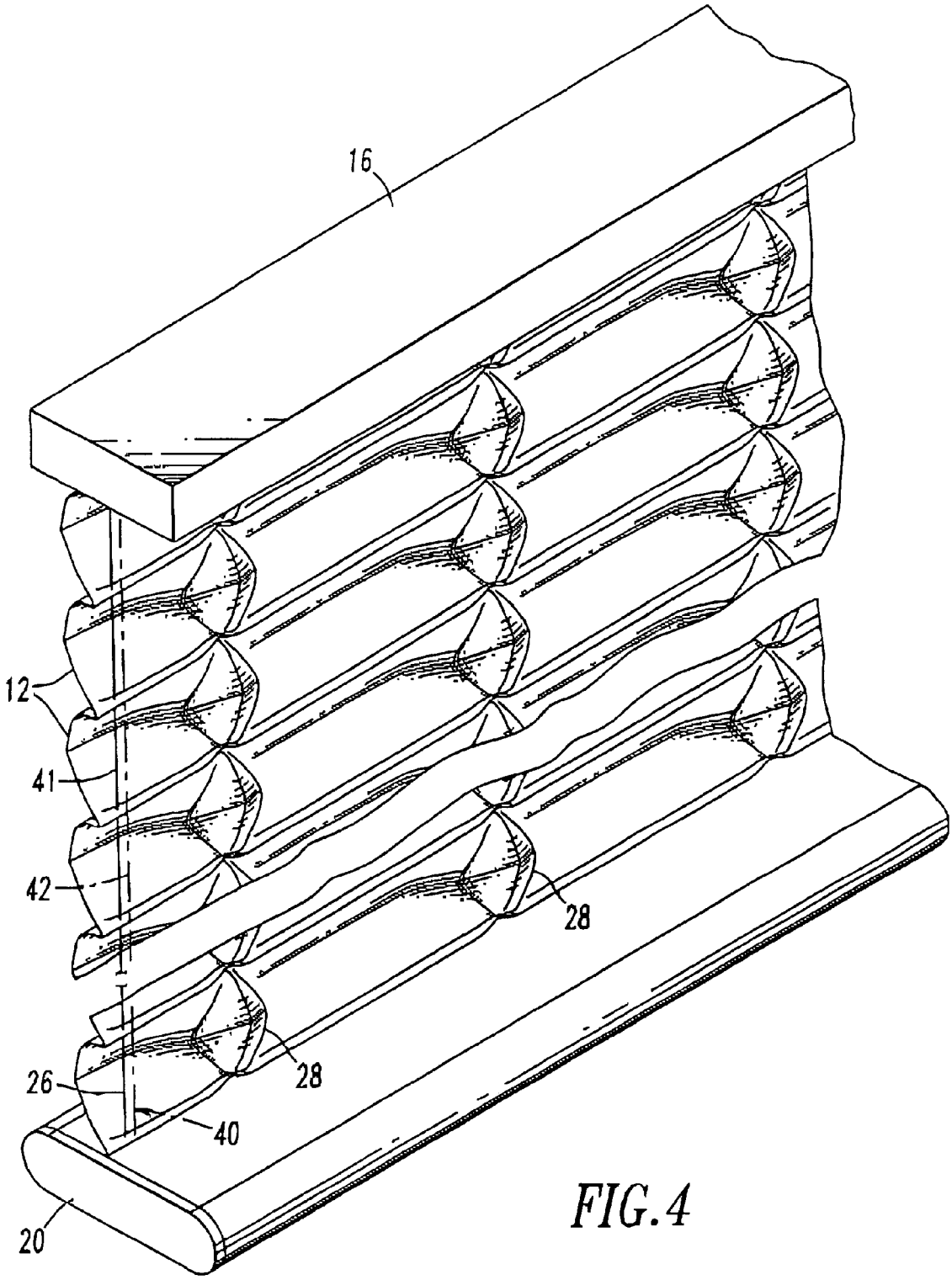
FIG. 4 is a rear perspective view of a portion of the pleated shade shown in FIG. 2 with an optional spacer device shown in chainline.

As shown in FIGS. 2 and 4, to create the textured appearance of the pleats 12, tabs 28 are provided at spaced apart locations at or near the crease, between adjacent back projecting pleats, or along the line where the back projecting pleats are joined together to create the pleated shade 30. As explained above, the space between the intermittent tabs 28 can vary depending on the desired appearance of the pleated shade 30 and the pleated material 15 used. If a softer pleated material 15 is used, the distance between tabs 28 generally must be shorter. I prefer 1½" to 1⅜" pleat with a ⅜" tab or around a 3 to 12 or 3 to 11 ratio. This ratio would change markedly if the dimensions were different because stiffness of fabric is very sensitive to its length. Finally, a spacer will change this ratio of tab to length because it prevents the tabbed area from going flat. I prefer a spacer between 1⅝" to 2" when used with fabric having pleat faces of 1⅜" to 1½ inch and a tab of ⅜". A very attractive shade was made using medium density coated polyester woven material. This shade had ⅜" tabs that were ⅝" in length. The spacing between tabs was 5¼. Generally, I have found that the distance between tabs can be between 3½" and 7" to provide a soft appearance. The length of the tab should be equal to or less than the length of the space. The shade should be made from woven or knitted material that maintains a pleat like polyesters. However, there may be some nonwoven material that will provide an attractive shade. Thermoplastics hold heat and set pleats and polyesters resist sun rot. Cottons and other natural fibers can be used with a spacer. Additionally, the position of tabs 28 on adjacent upper or lower pleats 12 along the length of the pleated shade 30 may be aligned or offset, according to the desired appearance of the pleated shade 30.

An intermittently tabbed pleated shade 30 according to the invention can be produced notwithstanding the particular manner of forming the pleats. The pleated material 15 may be joined together using well known techniques, for example, gluing, welding or sewing. Because of equipment and sampling the tabs and spaces will usually be the same for all shades. If the product is a really big hit it may be made in two sizes. Where a single sheet of pleated material is creased and bonded to form the pleats, the intermittent tabs 28 are preferably provided just inward from the crease. Similarly, where two sheets of pleated material are joined, the intermittent tabs 28 are preferably provided just inward from the line where the horizontal sections are joined. The method of creating the tabs 28, e.g. securing together portions of the material, can utilize conventional techniques, such as gluing, welding, or sewing.

As the shade 30 is hung, material below each tab 28, and the bottomrail 18 when not resting on the window sill, will exert a downward force. That force, if strong enough, could pull apart the tabs 28. The greatest forces will be exerted at the ends of the tabs 28 adjacent the puffs 32. To strengthen the tabs against this force, a second transverse bond line 34 can be placed at one or both ends of the main bond line 36, as illustrated in FIG. 5. Typically, this second bond line will be angled inward away from the portion of the material which is not tabbed.

Optionally one can provide a spacer 40 to maintain the spacing between pleats. Spacers maintain a uniform appearance from top to bottom, protect bond lines from concentrated loading and allow for a greater variety of fabric. Suitable spacer devices are disclosed in my U.S. Pat. No. 4,880,088. Such spacers have a cord 42 which runs from the headrail to the bottomrail. Loops are provided at spaced apart intervals. Each loop can be attached to the lift cord 26, pass through the route hole through which the lift cord passes or be attached to a tab.

Another option is to provide a liner on the back of the shade. The liner could be bonded to the tabs during the tabbing operation.

Although I have described the preferred embodiment as if it were a newly constructed shade, an existing shade could be modified to create this window covering.

Moreover, although certain embodiments of the invention have been described in detail, it will be appreciated by those skilled in the art that various modifications to those details could be developed in light of the overall teaching of the disclosure. Accordingly, the particular embodiments disclosed herein are intended to be illustrative only and not limiting to the scope of the invention which should be awarded the full breadth of the following claims and any and all embodiments thereof.

I claim:

1. Material for a pleated shade apparatus, said material comprising:

a. a piece of material having a plurality of sections of material, each two adjacent ones of said sections meeting at a pleat, alternate pleats projecting towards front and back sides of said material;

b. means for intermittently securing together said two adjacent sections of material forming each of said back projecting pleats at spaced apart locations along a width of said material to form intermittent tabs across a rear portion of each of said back projecting pleats; and c. said intermittent tabs causing said pleats to exhibit a textured appearance when said length of material is extended.

2. The pleated shade material of claim 1 wherein said means for intermittently securing together comprises a first bond line formed adjacent to said pleat.

3. The pleated shade material of claim 1 wherein said means for securing comprises at least one of gluing, sewing and welding.

4. The pleated shade material of claim 1 wherein adjacent tabs are spaced apart from one another a distance that does not exceed a length of a tab.

5. The pleated shade material of claim 1 wherein the shade material is a material selected from the group consisting of cotton, cotton blends, medium density coated polyester woven fabric and medium density coated polyester knitted fabric.

6. The pleated shade material of claim 1 also comprising a spacer device attached to the material.

7. A pleated shade that may be raised and lowered comprising:

a headrail;

a bottomrail;

a piece of material having a plurality of sections of material, each two adjacent ones of said sections meeting at a pleat preformed therein, alternate pleats projecting towards front and back sides of said material, said piece of material being connected at one end to said headrail and at the other end to said bottomrail;

means for intermittently securing together said two adjacent sections of material forming each of said back projecting pleats, said intermittent tabs provided at spaced apart locations along a width of said material to form intermittent tabs across a rear portion of each of said back projecting pleats, said intermittent tabs creating a textured appearance when said pleated shade is lowered;

at least one cord hole formed through each of said pleats, corresponding cord holes in each of said pleats being accurately aligned one on top of the other; and a cord extending from said headrail through corresponding cord holes in each of said pleats to said bottomrail, said cord being adapted, when operated, to control the raising and lowering of said shade.

8. The pleated shade of claim 7 wherein said means for intermittently securing together comprises a first bond line formed adjacent to said pleat.

9. The pleated shade of claim 7 wherein said means for securing comprises at least one of gluing, sewing and welding.

10. The pleated shade of claim 7 wherein adjacent tabs are spaced apart from one another a distance that does not exceed a length of a tab.

11. The pleated shade material of claim 7 wherein the shade material is a material selected from the group consisting of cotton, cotton blends, medium density coated polyester woven fabric and medium density coated polyester knitted fabric.

12. The pleated shade material of claim 7 also comprising a spacer device attached to at least one of the cord and a plurality of tabs.

13. Material for a pleated shade apparatus, said material comprising:

a. a piece of material having a plurality of sections of material, each two adjacent ones of said sections meeting at a pleat, alternate pleats projecting towards front and back sides of said material, b. means for intermittently securing together said two adjacent sections of material forming each of said back projecting pleats at spaced apart locations along a width of said material to form intermittent tabs across a rear portion of each of said back projecting pleats; and c. said intermittent tabs causing said pleats to exhibit a textured appearance when said length of material is extended;

d. wherein said means for intermittently securing together comprises a first bond line formed adjacent to said pleat; and e. wherein said means for intermittently securing together further comprises at least a second bond line formed transverse to said first bond.

14. The pleated shade material of claim 13 wherein said means for intermittently securing together further comprises second and third bond lines each formed transverse to said first bond line and one of said second and third transverse bond lines provided on opposite ends of said first bond line.

15. A pleated shade that may be raised and lowered comprising:

a headrail;

a bottomrail;

a piece of material having a plurality of sections of material, each two adjacent ones of said sections meeting at a pleat preformed therein, alternate pleats projecting towards front and back sides of said material, said piece of material being connected at one end to said headrail and at the other end to said bottomrail;

means for intermittently securing together said two adjacent sections of material forming each of said back projecting pleats, said intermittent tabs provided at spaced apart locations along a width of said material to form intermittent tabs across a rear portion of each of said back projecting pleats, said intermittent tabs creating a textured appearance when said pleated shade is lowered;

at least one cord hole formed through each of said pleats, corresponding cord holes in each of said pleats being accurately aligned one on top of the other;

a cord extending from said headrail through corresponding cord holes in each of said pleats to said bottomrail, said cord being adapted, when operated, to control the raising and lowering of said shade;

wherein said means for intermittently securing together comprises a first bond line formed adjacent to said pleat; and wherein said means for intermittently securing together further comprises at least a second bond line formed transverse to said first bond line.

16. The pleated shade of claim 15 wherein said means for intermittently securing together further comprises second and third bond lines each formed transverse to said first bond line and one of said second and third transverse bond lines provided on opposite ends of said first bond line.

* * * * *

UNITED STATES PATENT AND TRADEMARK OFFICE

CERTIFICATE OF CORRECTION

PATENT NO. : 6,347,658 B1
DATED : February 19, 2002
INVENTOR(S) : Ren Judkins

It is certified that error appears in the above-identified patent and that said Letters Patent is hereby corrected as shown below:

Column 5,
Line 56, after "tabs" insert -- causing separation of two adjacent sections between said tabs thereby --.

Column 6,
Line 23, after "tabs" insert -- causing separation of said two adjacent sections between said tabs thereby --.

Signed and Sealed this

Fourteenth Day of May, 2002

*Attest:*

*Attesting Officer*

JAMES E. ROGAN
*Director of the United States Patent and Trademark Office*